US008763497B2

(12) United States Patent
Novkov

(10) Patent No.: US 8,763,497 B2
(45) Date of Patent: Jul. 1, 2014

(54) HYDRAULIC WRENCH EXTENSION

(76) Inventor: Donald James Novkov, Encinitas, CA (US)

( * ) Notice: Subject to any disclaimer, the term of this patent is extended or adjusted under 35 U.S.C. 154(b) by 233 days.

(21) Appl. No.: 13/476,814

(22) Filed: May 21, 2012

(65) Prior Publication Data

US 2013/0047432 A1 Feb. 28, 2013

Related U.S. Application Data

(60) Provisional application No. 61/526,024, filed on Aug. 22, 2011.

(51) Int. Cl.
*B25B 21/00* (2006.01)
*B25B 23/00* (2006.01)

(52) U.S. Cl.
CPC ..... *B25B 21/00* (2013.01); *B25B 23/0028* (2013.01)
USPC ..... 81/57.44

(58) Field of Classification Search
USPC ..... 81/57.44, 57.36, 53.12, 64, 65.2
See application file for complete search history.

(56) References Cited

U.S. PATENT DOCUMENTS

| | | | |
|---|---|---|---|
| 3,930,776 | A | 1/1976 | Keller |
| 4,027,561 | A | 6/1977 | Junkers |
| 4,079,641 | A | 3/1978 | Junkers |
| 4,201,099 | A | 5/1980 | Junkers |
| 4,336,727 | A | 6/1982 | Junkers |
| 4,513,644 | A | 4/1985 | Weyer |
| 4,794,825 | A | 1/1989 | Schmoyer |
| 4,846,028 | A | 7/1989 | Junkers |
| 5,140,874 | A | 8/1992 | Junkers |
| 5,301,574 | A | 4/1994 | Knopp |
| 6,578,643 | B2 | 6/2003 | Izumisawa |
| 6,912,933 | B2 | 7/2005 | Knopp |
| 7,062,992 | B2 | 6/2006 | Spirer |
| 7,555,971 | B2 | 7/2009 | Sosnowski |

*Primary Examiner* — David B Thomas
(74) *Attorney, Agent, or Firm* — Coastal Patent Law Group, P.C.; Joshua S. Schoonover

(57) ABSTRACT

A hydraulic wrench extension includes an input head connected to an output head via a fluid conduit. The input head is adapted to receive an input torque and convert the input torque into hydraulic fluid pressure. The fluid conduit is adapted to communicate the pressurized hydraulic fluid from the input head to the output head. The output head is adapted to convert the hydraulic fluid pressure into torque for applying to a fastener. The hydraulic wrench extension may comprise an articulating linkage adapted to house the fluid conduit and provide a configurable orientation of the wrench extension for traversing obstacles and accessing difficult-to-reach fasteners.

19 Claims, 5 Drawing Sheets

HYDRAULIC WRENCH EXTENSION

CROSS-REFERENCE TO RELATED APPLICATIONS

This application claims benefit of priority to U.S. Provisional Ser. No. 61/526,024, filed Aug. 22, 2011, and titled "HYDRAULIC WRENCH EXTENSION"; the contents of which are hereby incorporated by reference.

BACKGROUND OF THE INVENTION

1. Field of the Invention

This invention relates to tools and tool accessories; and more particularly to a structurally configurable hydraulic wrench extension adapted to provide mechanical torque for tightening and loosening fasteners such as nuts and bolts.

2. Description of the Related Art

Hydraulic torque wrenches are commonly used for tightening and loosening fasteners such as nuts and bolts, especially large size nuts and bolts. In many applications, it is desirable to control an amount of torque applied to a bolt or nut such that the fastener is tightened to a desired specification. More commonly, a plurality of fasteners are often used to attach two components of a machine or other equipment or structure, and in certain applications each of the fasteners is desired a specific torque for maintaining integrity of a seal therebetween. However, in other applications the torque at which one or more fasteners is tightened may not be of significant scrutiny.

Modern commercially-available hydraulic torque wrenches are often used for flange bolting of pipes or other structures. However, these wrenches can also be used for automotive, home, and other applications. These torque wrenches generally require an external hydraulic pump for communicating hydraulic fluid; the fluid often extends from the pump to the hydraulic wrench and back to the pump through one or two lines of conduit such as a tubing or hose. Thus, these torque wrenches are not readily portable without toting additional conduit and pump equipment.

Other tools are commonly used for tightening and loosening various fasteners, including: ratchets or socket wrenches, mechanical torque wrenches, and power driven devices such as power drivers and others, these power driven devices being available in plug-in and battery powered varieties. However, these tools are often not suitable for reaching certain "difficult-to-reach" fasteners such as those fasteners with obstructed access or being positioned behind other parts or structures. Thus, there is a need for an extension tool adapted for lightweight and portable use, diverse adaptation for use with a multitude of existing hand tools for supplying input mechanical energy, and in certain cases, an articulating structural configuration for customizing an angle or approach for extending a ratcheting function to those difficult-to-reach fasteners.

Modern hydraulic torque wrenches generally include a radial vane or similar type of converter for converting fluid pressure into rotational torque. Other hydraulic torque wrenches may employ a mechanical means for converting input energy into rotational torque. Some instruments may further use a geared mechanism for multiplying torque output. However, even in the crowded art of hydraulic tools and accessories there has yet to be disclosed or made available a hydraulic wrench extension adapted to convert an input torque to hydraulic fluid pressure at one end and further convert the hydraulic fluid pressure into rotational torque at a second end.

Moreover, the need for configurable structure of such a wrench extension for accessing difficult-to-reach fasteners is a key problem in the art which has yet to be resolved.

Accordingly, a wrench extension adapted to receive an input torque and communicate the input torque to an output drive through a structurally configurable structure for accessing difficult-to-reach fasteners is of immediate need in the art.

SUMMARY OF THE INVENTION

In the embodiments herein, a hydraulic wrench extension is adapted to receive an input torque supplied from a hand-operated ratchet, torque wrench, or power driver, and communicate the input torque from an input head to an output head at an opposite end via one or more hydraulic conduits. In certain embodiments a hydraulic conduit extends about a configurable structure or linkage. In this regard, the wrench extension is adapted to traverse difficult-to-reach areas and securely apply an output torque to a fastener.

In certain embodiments herein, the wrench extension accomplishes these and other problematic tasks by providing an articulating configurable structure or linkage having a flexible hydraulic fluid conduit extending therein for communicating hydraulic fluid pressure from a first input end to a second output end opposite of the input end. At the input end, an input head comprises a torque input receiver being configured to receive an input torque and convert the input torque to hydraulic fluid pressure. Similarly, at the output end, an output head is adapted to convert received hydraulic fluid pressure into an output torque. In this regard, any torque input, such as from a powered driver or mechanical torque wrench, is converted to hydraulic fluid pressure at the input head and communicated through an articulating configurable structure to an output head, wherein the hydraulic pressure is converted back into rotational torque and the displaced fluid is returned from the output head to the input head.

Thus, the hydraulic wrench extension is capable of traversing obstacles and accessing difficult-to-reach fasteners by way of configuration of the linkage, and providing sufficient torque to tighten or loosen a fastener by converting mechanical torque energy into hydraulic pressure and back to torque.

Other features and benefits of the various embodiments are further described in the following detailed description, and may be particularly understood in conjunction with a review of the appended drawings.

DETAILED DESCRIPTION OF THE PREFERRED EMBODIMENTS

Figure 1:
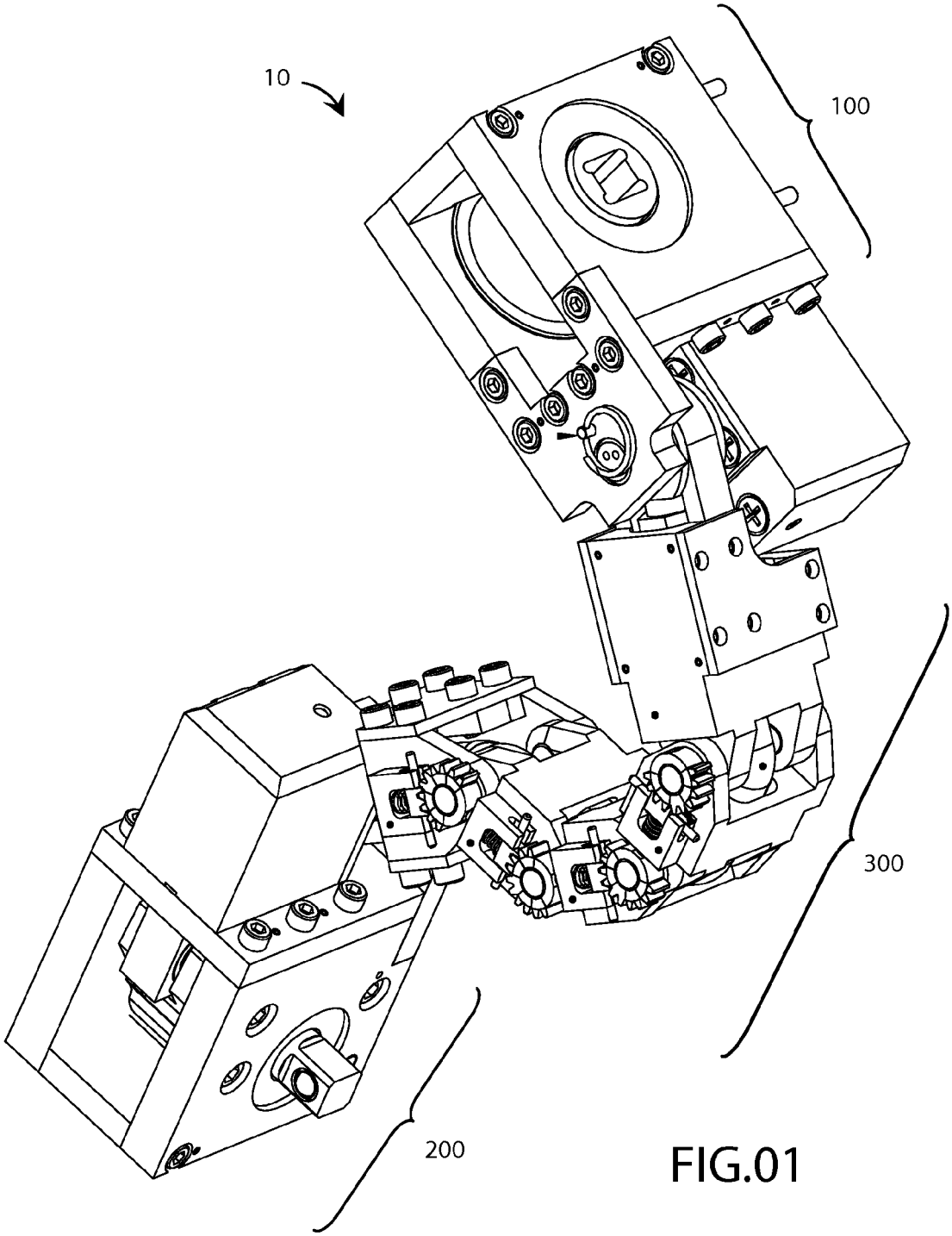
FIG. 01 illustrates a perspective view of a hydraulic wrench extension in accordance with an embodiment; the wrench extension comprises a hydraulic fluid conduit extending from an input head through an articulating configurable linkage toward an output head.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

In a general embodiment, an hydraulic wrench extension is adapted to receive an input torque at an input head thereof, convert the input torque to hydraulic fluid pressure or hydraulic force per unit area, and communicate the pressurized hydraulic fluid through an articulating configurable structure toward an output head, wherein the output head is adapted to receive the pressurized hydraulic fluid, convert the hydraulic fluid pressure to rotational torque, and produce an output torque therefrom.

The hydraulic wrench extension is adapted to traverse difficult-to-reach areas for accessing remote fasteners such as nuts and bolts. In this regard, the hydraulic wrench extension serves to provide a configurable structure for bending past obstructions and supplying a torque for tightening and loosening difficult-to-reach fasteners. It should be noted that although the hydraulic wrench extension is particularly useful for addressing difficult-to-reach fasteners, the extension can be used for tightening or loosening virtually any fastener, even those that may be readily accessible.

The hydraulic wrench extension generally comprises an input head adapted to receive an input torque and convert the input torque into hydraulic fluid pressure. The input head may comprise any mechanical means for converting a rotational input torque to hydraulic fluid pressure, such as a cam and piston or radial vane type mechanism. The pressurized hydraulic fluid is then communicated through an articulating configurable structure or linkage, such as for example, by way of one or two conduits or tubes extending from the input head and through the linkage. The pressurized hydraulic fluid is communicated to an output head disposed at an end of the wrench extension that is opposite of the input head. At the output head, the hydraulic fluid pressure is converted back into rotational torque for driving an output socket or other torque adapter. Hydraulic fluid may flow in one direction in a continuous circuit through two conduits, or may flow through a single conduit in a back-and-forth manner. Rotational displacement results from and is caused by the hydraulic fluid displacement.

In certain embodiments, one or both of the input and output heads may individually be adapted for engaging one or more sockets, socket adapters, or other torque adapters.

In certain other embodiments, the linkage can comprise a plurality of hinged linkage elements collectively defining an articulating structure. Flexible tubing may extend through the linkage from the input head to the output head such that the tubing is contained by the linkage for preventing tangling or puncture thereof. Alternatively, the tubing may be disposed externally to the linkage structure.

In one embodiment, a handle mechanism can be provided for counter-balancing the reactive forces resulting from the application of torque to the hydraulic wrench extension.

Now turning to the drawings, FIG. 01 illustrates a perspective view of a wrench extension in accordance with an embodiment; the wrench extension comprises a configurable linkage portion 300 extending between an input head portion 100 and an output head portion 200. The input head is adapted to receive an input torque and convert the input torque to hydraulic fluid pressure for communicating through a hydraulic fluid conduit toward an output head. The input torque can originate from many known instruments, such as a hand-held socket wrench or torque wrench, or an electric wrench or driver, among others.

The linkage 300 is adapted to couple input head 100 to output head 200, house a hydraulic fluid conduit or tubing, and provide configurable articulation for adapting the wrench extension in various orientations for traversing obstacles and engaging difficult-to-reach fasteners. The configurable linkage may further comprise locking elements for maintaining a configuration of the linkage portion of the wrench extension. In the illustrated embodiments the locking elements comprise a number of spring-loaded locking elements positioned on a plurality of individual linkage elements.

The hydraulic wrench extension illustrated in FIG. 01 comprises an input head 100 connected to an output head 200 via a hydraulic fluid conduit extending therebetween. The input head 100 is adapted to engage at least a portion of a torque providing instrument, receive torque applied therefrom, and convert said torque into hydraulic fluid pressure. The torque providing instrument can be a hand-held socket wrench, torque wrench, or a power driven wrench, among others. The hydraulic fluid conduit is adapted to communicate the pressurized hydraulic fluid from the input head to the output head. The output head is adapted to receive the pressurized hydraulic fluid, convert the hydraulic fluid pressure into torque and supply torque at a torque output thereon. It should be noted that FIG. 01 further illustrates a linkage 300 extending between the input head 100 and output head 200. The linkage is adapted to provide articulating configuration of the wrench extension for traversing obstacles and providing access to difficult-to-reach fasteners. Although the hydraulic fluid conduit is illustrated as extending within a lumen space of the linkage, the hydraulic fluid conduit or conduits may alternatively extend along an outer surface of the linkage, or in certain embodiments no linkage is provided and the one or more conduits extend to connect the input and output heads.

Figure 2:
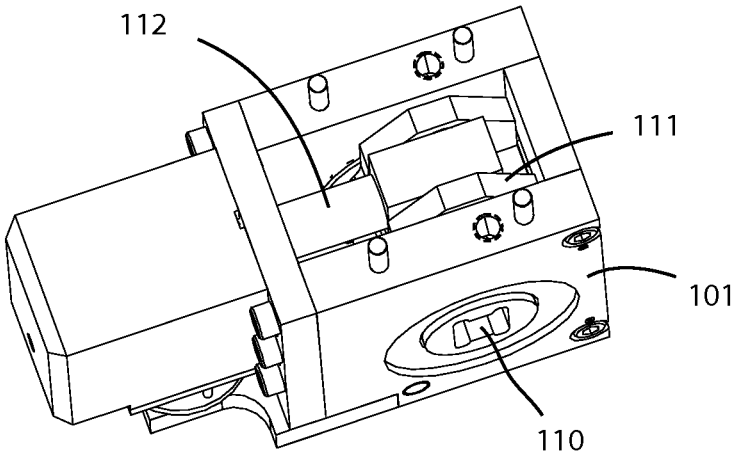
FIG. 02 is a perspective view of an input head according to the embodiment of FIG. 01.
Figure 3:
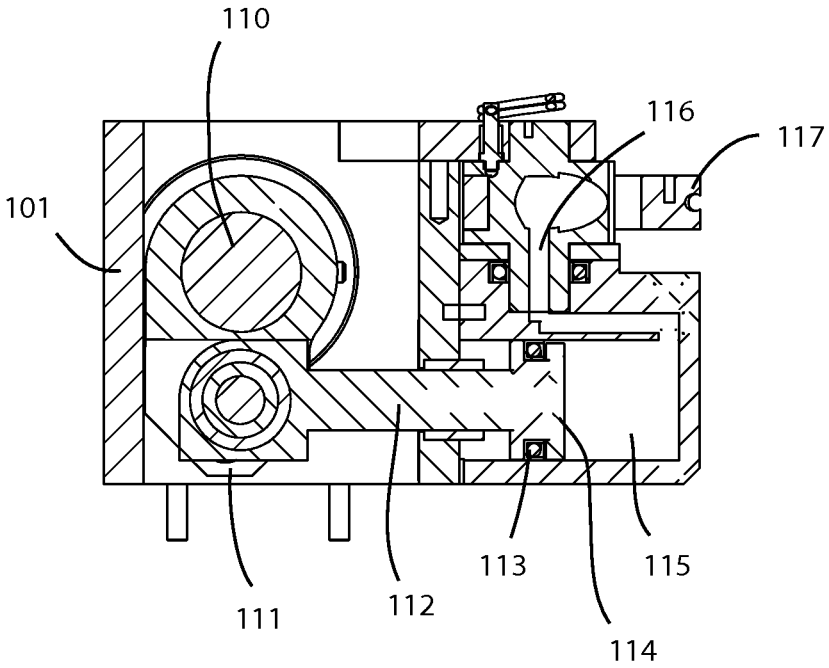
FIG. 03 is a sectional view of an input head in accordance with an embodiment.

FIGS. 02-03 represent a perspective view of an input head in accordance with an embodiment as illustrated in FIG. 01, and a sectional view thereof, respectively. The input head comprises a first housing 101 or input head housing. The first housing 101 comprises a rotatable torque input 110 for connecting a source of torque to the first housing. As described above, the source of torque may include a hand-held socket wrench, torque wrench, or a power driven wrench, among others. The rotatable torque input comprises a first cam portion 111 extending radially outwardly from the torque input. The first cam portion is substantially contained within the first housing. A first piston 112 comprises a first end and a second end opposite of the first end. The first piston 112 is connected to the first cam portion 111 of the rotatable torque input at the first end. The first piston 112 further comprises a seal 113, such as an o-ring or other seal at a piston head portion 114 disposed at the second end of the first piston 112. The piston head portion 114 and seal 113 at least partially extend within a first bore 115. The bore is a hollowed volume adapted to contain an amount of hydraulic fluid. A channel 116 extends from the first bore 115 to an outlet port 117 of the first housing for communicating hydraulic fluid therebetween.

It should be noted that the first piston of the input head and second piston of the output head may comprise similar or different surface areas, respectively. In this regard, the hydraulic pressure communicated from the first piston to the second piston can be designed to increase or reduce torque on the output end. Alternatively, the piston sizes may be similar for providing an output torque that is substantially equal to the input torque.

Figure 4:
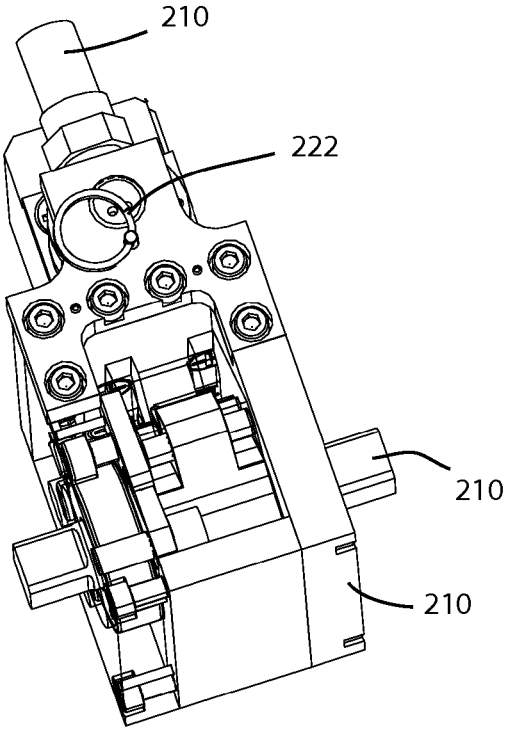
FIG. 04 is a perspective view of an output head according to the embodiment of FIG. 01.
Figure 5:
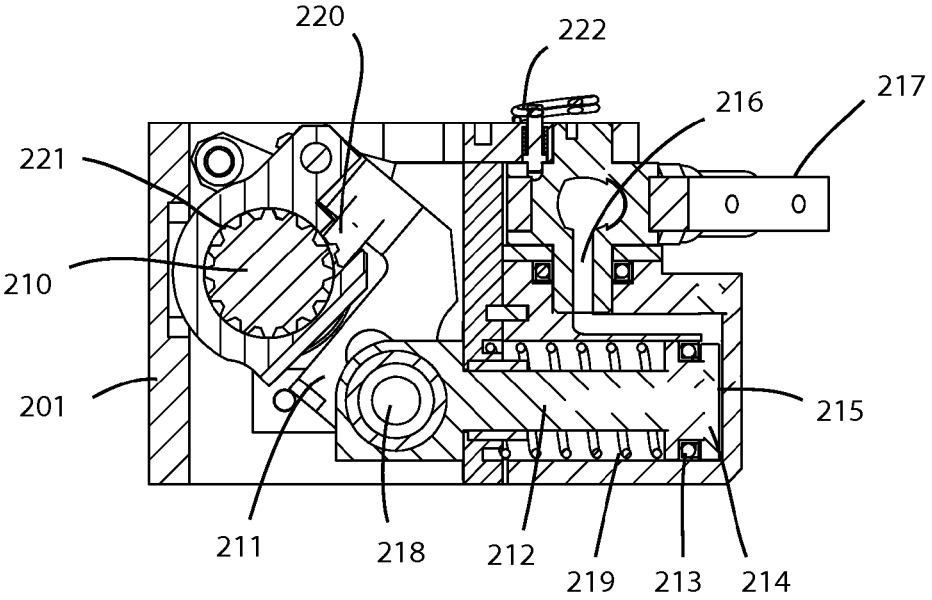
FIG. 05 is a sectional view of an output head in accordance with an embodiment.

FIGS. 04-05 represent a perspective view of an output head in accordance with an embodiment as illustrated in FIG. 1, and a sectional view thereof, respectively. The output head comprises a second housing 201 or output head housing. The second housing 201 comprises a rotatable torque output 210 for providing useful torque. The torque can be provided to a fastener using a socket, or the torque output may be configured with a desired size and shape for engaging specific fasteners. The rotatable torque output comprises a second cam portion 211 extending radially outwardly from the torque output. The second cam portion is substantially contained within the second housing. A second piston 212 comprises a first end and a second end opposite of the first end. The second piston 212 is connected to the second cam portion 211 of the rotatable torque output at a fulcrum 218. The second piston 212 further comprises a seal 213, such as an o-ring or other seal at a piston head portion 214 disposed at the second end of the second piston 212. The piston head portion 214 and seal 213 at least partially extend within a second bore 215. The bore is a hollowed volume adapted to contain an amount of hydraulic fluid. A channel 216 extends from the second bore 215 to an inlet port 217 of the second housing for communicating hydraulic fluid therebetween. A piston spring 219 provides recoil force between the second piston head 214 and an upper end of the bore 215. The cam portion 211 further comprises a ratcheting member 220 adapted to engage one or more teeth 221 of the rotational torque output 210 such that the torque output may rotate in a first rotational direction and may be prevented from rotating in a second rotational direction opposite of the first rotational direction.

In this regard, as fluid is pumped into the second bore 215, the second piston head 214 is translated against the piston spring and levers the cam portion 211 about the fulcrum 218 such that the ratcheting member 220 engages one or more teeth 221 and rotates the torque output to provide a torque thereabout. During recoil, the ratcheting member 220 slips against the teeth 221 as the piston spring force recoils the second piston 212 to a home position returning the displaced fluid. This cyclical ratcheting can be performed continuously for loosening or tightening a fastener.

It should be understood that although the embodiment of FIG. 01 illustrates the input head 100 comprising a single female socket-type receiver at the torque input, the input head may further comprise a torque input on the opposite side of the input head, such that two torque inputs are provided with one of the inputs being disposed on each opposing side of the input head. It should also be noted that the female-type socket receivers can be configured with a myriad of receiver types, such as a ¼ inch, ⅜ inch, or ½ inch square drive, or various other alternatives as known in the art. Moreover, a first female socket-type receiver may comprise a ⅜ inch square drive receiver and be disposed on a first side of the input head, and a second female socket-type receiver may comprise a different size receiver such as ¼ inch or ½ inch and be disposed on a second side of the input head opposite of the first side. Various other configurations involving the input head receiver would be appreciated by those having skill in the art.

Similarly, the output head 200 may comprise one or more male socket-type adapters at the rotatable torque output, with a first male socket adapter on a first side and an optional second male socket type adapter on a second side opposite of the first side. Additionally, ¼ inch, ⅜ inch, and ½ inch male socket adapters can be configured on the output head.

Moreover, a slideable torque output can be provided for configuring a male socket-type adapted between a first side and a second side opposite of the first side of the output head. In this regard, a rotatable torque output comprises an elongated shaft having a male socket-type adapted at each end thereof, and a gear disposed near a middle portion of the shaft, the gear having a plurality of teeth disposed circumferentially about the shaft circumference. The output head is adapted to engage the gear portion of the slideable torque output when a first end of the output extends outwardly from the output head housing, and when a second end of the output extends outwardly from the output head housing on the opposing side. A user simply pushes one of the first and second ends of the output shaft to depress the output such that a desired configuration is achieved.

Figure 6A:
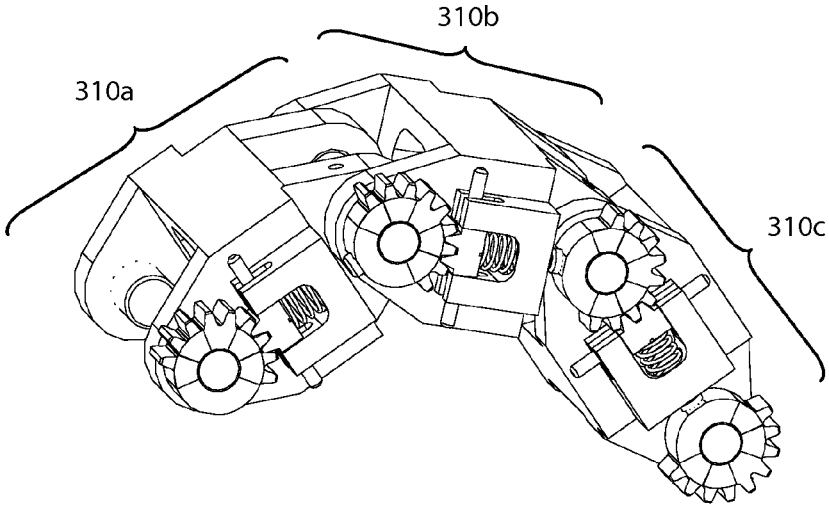
FIG. 06*a* is a perspective view of a linkage in accordance with the embodiment of FIG. 01.
Figure 6B:
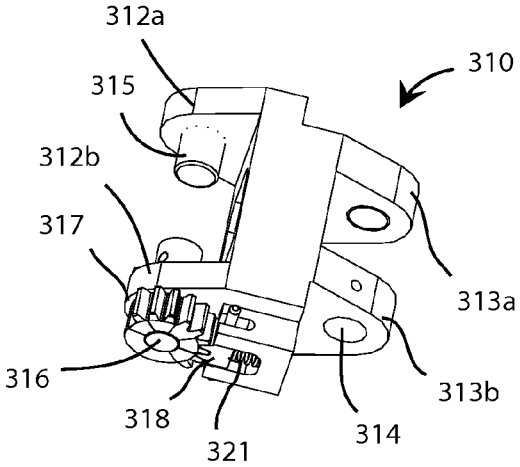
FIG. 06*b* is a perspective view of a linkage element from a top perspective.
Figure 6C:
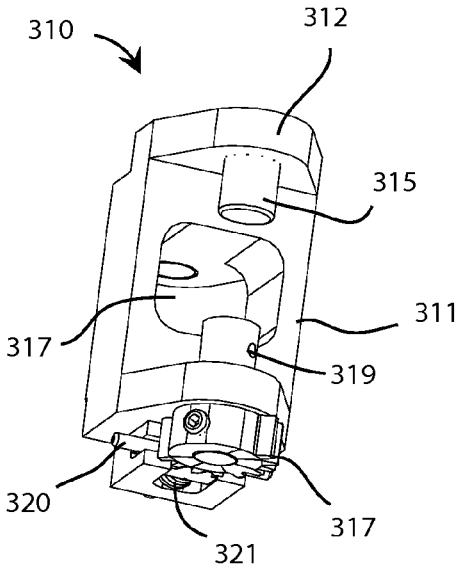
FIG. 06*c* is a perspective view of a linkage element from a side perspective.

FIG. 06(*a-c*) illustrate a linkage portion 300 according to an embodiment of the invention. The linkage 300 comprises a plurality of linkage elements 310*a*, 310*b*, 310*c*, each adapted to articulate a configuration of the linkage for configuring a desired trajectory of the hydraulic wrench extension.

In the embodiment of FIG. 06, each linkage element 310 comprises a body portion 311 having two opposing flanges 313*a*, 313*b* extending outwardly from the body portion. The opposing flanges 313 are spaced a distance apart and individually comprise an aperture 314 for securing the opposing flanges to an adjacent linkage element. A lumen cavity 317 extends through the linkage body portion 311 for housing a hydraulic fluid conduit of the hydraulic wrench extension. The body portion 311 further comprises a fixed flange adapter 312*a* having an extrusion extending inwardly toward the lumen cavity, and a hollow flange adapter 312*b* having an aperture thereon adapted to receive a geared pin 316. In this regard, the extrusion 315 of the fixed flange adapter of a first linkage element is connected to a first opposing flange 313 of a second linkage element and a geared pin 316 is inserted into the aperture of the hollow flange adapter 312*b* of the first linkage element such that the pin extends through the aperture of a second opposing flange of the second linkage element, thus securing the first and second linkage elements in a hinged fashion. Two or more linkage elements may be secured to form a linkage 300.

A locking element can be provided, such as a spring-loaded locking element. The spring-loaded locking element as illustrated in FIG. 06 comprises a geared pin having one or more teeth 317, a gripping element 318 adapted to engage one or more teeth of the geared pin, a spring adapted to supply spring force to the gripping element for maintaining engagement between the gripping element and the teeth of the geared pin, and a lever 320 for removing the gripping element from the teeth to allow for configuration of the linkage elements.

Figure 7:
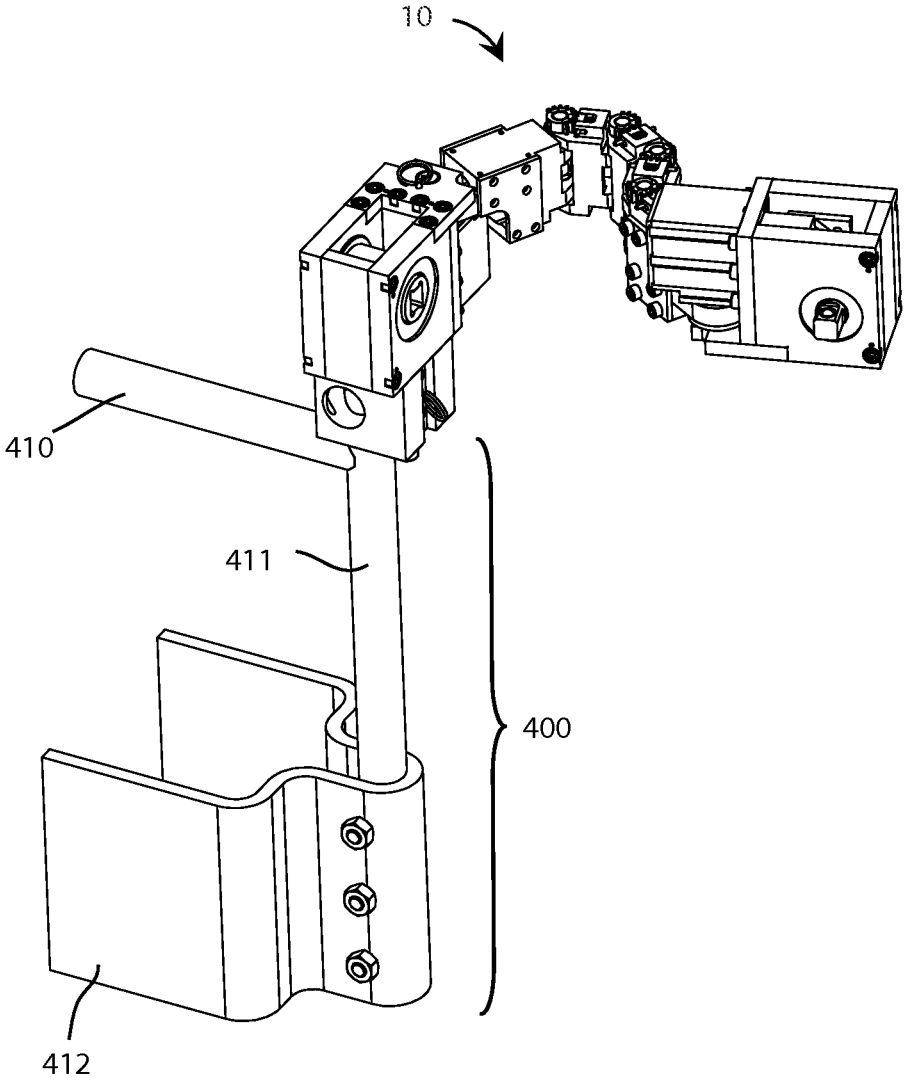
FIG. 07 illustrates a perspective view of a wrench extension and attached handle mechanism in accordance with an embodiment.

In another embodiment, the amount of torque present with the hydraulic wrench extension may require additional leverage for supporting the wrench extension, thus a handle is provided as illustrated in FIG. 07. The handle 400 is adapted to removably attach to the hydraulic wrench extension 10 for supplying additional leverage and support. The handle comprises a gripping portion 410 connected to an elongated rod 411 at a first proximal end, and an arm coupler 412 connected to the elongated rod 411 at a second distal end. The elongated rod is connected to the hydraulic wrench extension.

In yet another embodiment, the linkage may comprise various linkage elements adapted for rotation and articulation using one or more hinges, sockets, rotatable joints, or other joints, for providing a three-dimensional configuration of the linkage.

Although certain embodiments are illustrated and described herein it should be recognized by those having skill in the art that various alternatives would be readily apparent upon a review of the disclosed embodiments and that the scope of the invention is not limited to the illustrated examples but includes various alternatives as set forth in the appended claims.

What is claimed is:

1. A hydraulic wrench extension, comprising:

a first housing adapted to contain one or more input head components, said input head components comprising:

a rotatable torque input for connecting a source of torque to the first housing, the rotatable torque input comprising a first cam extending radially outwardly from a center thereof; and a first piston connected to the rotatable torque input at the first cam, said first piston at least partially engaged with a first bore within the first housing, said first bore coupled to a first fluid channel extending from said first bore to an outlet port of the first housing;

a second housing adapted to contain one or more output head components, said output head components comprising:

a rotatable torque output for providing an output torque, the rotatable torque output comprising a second cam extending radially outwardly from a center thereof; and a second piston connected to the rotatable torque output at the second cam, said second piston at least partially engaged with a second bore within the second housing, said second bore coupled to a second fluid channel extending from said second bore to an inlet port of the second housing;

a hydraulic fluid conduit extending between said outlet port of said first housing and said inlet port of said second housing forming a fluid communication between said first bore and said second bore;

wherein said first housing and input components therein are adapted to receive an input torque and convert said input torque into hydraulic fluid pressure;

wherein said hydraulic fluid conduit is adapted to communicate said hydraulic fluid pressure from said first bore to said second bore; and wherein said second housing and output head components are adapted to convert said hydraulic fluid pressure into torque for rotating said rotatable torque output.

2. The hydraulic wrench extension of claim 1, comprising a linkage extending between said first housing and said second housing.

3. The hydraulic wrench extension of claim 2, said linkage comprising a plurality of linkage elements being hingedly connected to one another.

4. The hydraulic wrench extension of claim 3, said linkage is adapted for two-dimensional configuration.

5. The hydraulic wrench extension of claim 3, said linkage is adapted for three-dimensional configuration.

6. The hydraulic wrench extension of claim 3, at least one of said linkage elements comprising a locking element for securing an orientation therebetween.

7. The hydraulic wrench extension of claim 6, wherein said locking element comprises a spring-loaded locking element, said spring loaded locking element comprising a gear element having a plurality of teeth, a gripping element adapted to engage one or more of said teeth of the gear element, a spring adapted to supply spring force to the gripping element for maintaining engagement between said gripping element and said teeth, and a lever for removing said gripping element from said teeth.

8. The hydraulic wrench extension of claim 2, said linkage comprising a lumen extending through a center thereof, wherein said hydraulic fluid conduit is disposed within said lumen.

9. The hydraulic wrench extension of claim 1, comprising a second hydraulic fluid conduit adapted for fluid communication between said input head and said output head.

10. A hydraulic wrench extension, comprising:

an input head connected to an output head via at least one hydraulic fluid conduit;

said input head adapted to engage at least a portion of a torque providing instrument, receive a first torque applied therefrom, and convert said first torque into hydraulic fluid pressure;

said at least one hydraulic fluid conduit adapted to communicate said hydraulic fluid pressure between said input head and said output head;

said output head adapted to receive said hydraulic fluid pressure, convert said hydraulic fluid pressure into a second torque and supply said second torque at a torque output.

11. The hydraulic wrench extension of claim 10, further comprising a linkage for configuring an orientation of the hydraulic wrench extension for traversing obstacles and accessing difficult-to-reach fasteners.

12. The hydraulic wrench extension of claim 10, wherein said second torque is larger than said first torque.

13. A method for providing torque from an instrument, comprising:

providing an input head adapted to engage a torque providing instrument and receive an input torque therefrom;

converting said input torque to a hydraulic fluid pressure at said input head;

communicating said hydraulic fluid pressure from the input head to an output head via at least one fluid conduit;

converting said hydraulic fluid pressure to an output torque at said output head;

wherein said output torque is expelled from said output head at a torque output.

14. The method of claim 13, wherein said torque output is a socket adapted to engage a fastener.

15. The method of claim 13, further comprising: configuring an orientation of a linkage extending between the input head and the output head for traversing an obstructed access and engaging a fastener.

16. The method of claim 13, wherein said hydraulic pressure is converted to torque at a radial vane mechanism.

17. The method of claim 13, wherein said hydraulic pressure is converted to torque at a cam and piston mechanism.

18. The method of claim 13, further comprising: attaching a handle for stabilizing the instrument with an external object.

19. The method of claim 18, wherein said handle is adapted to engage an arm of a user.

* * * * *